US011045028B1

(12) United States Patent
Lenhardt

(10) Patent No.: US 11,045,028 B1
(45) Date of Patent: Jun. 29, 2021

(54) DRINKING STRAW WITH AGITATOR

(71) Applicant: Jason Lenhardt, Amana, IA (US)

(72) Inventor: Jason Lenhardt, Amana, IA (US)

( * ) Notice: Subject to any disclaimer, the term of this patent is extended or adjusted under 35 U.S.C. 154(b) by 429 days.

(21) Appl. No.: 16/244,604

(22) Filed: Jan. 10, 2019

Related U.S. Application Data

(60) Provisional application No. 62/617,402, filed on Jan. 15, 2018.

(51) Int. Cl.

| | |
|---|---|
| ***A47G 21/18*** | (2006.01) |
| ***B01F 7/00*** | (2006.01) |
| ***B01F 13/00*** | (2006.01) |
| ***B01F 15/00*** | (2006.01) |

(52) U.S. Cl.
CPC ..... *A47G 21/185* (2013.01); *B01F 7/007* (2013.01); *B01F 7/00583* (2013.01); *B01F 7/00708* (2013.01); *B01F 13/0018* (2013.01); *B01F 15/00441* (2013.01); *B01F 15/00506* (2013.01); *B01F 2215/0022* (2013.01)

(58) Field of Classification Search
CPC ..... A47G 21/185; B01F 15/00506; B01F 13/0018; B01F 7/00583; B01F 7/007; B01F 15/00441; B01F 7/00708; B01F 2215/0022
See application file for complete search history.

(56) References Cited

U.S. PATENT DOCUMENTS

| | | | | |
|---|---|---|---|---|
| 2,613,107 | A * | 10/1952 | Hartnett | A47G 21/181 239/33 |
| 3,315,405 | A * | 4/1967 | Hoffer | A63H 33/40 446/71 |
| 3,545,980 | A * | 12/1970 | Stranger | A47G 21/183 426/85 |
| 3,776,458 | A * | 12/1973 | Chunga, Sr. | B65D 77/283 239/33 |
| 4,252,273 | A * | 2/1981 | Karterman | A47G 21/182 239/33 |
| 4,408,690 | A * | 10/1983 | Ferrero | B01F 13/002 206/219 |
| D371,930 | S | 7/1996 | Huang | |
| 5,634,714 | A | 6/1997 | Guild | |
| 6,056,206 | A * | 5/2000 | Whiton | A47G 21/181 215/388 |
| D426,742 | S | 6/2000 | Gartz et al. | |
| 6,561,434 | B2 * | 5/2003 | Kaplan | A47G 21/181 239/24 |
| D510,678 | S | 10/2005 | Krasne et al. | |
| 7,100,838 | B1 | 9/2006 | Epstein | |
| 7,441,941 | B2 | 10/2008 | Vernon | |

(Continued)

FOREIGN PATENT DOCUMENTS

| | | | |
|---|---|---|---|
| CA | 2853148 | A1 | 11/2014 |
| CA | 2969844 | A1 | 6/2016 |

(Continued)

*Primary Examiner* — Tony G Soohoo
(74) *Attorney, Agent, or Firm* — Shuttleworth & Ingersoll PLC; Jason R. Sytsma

(57) ABSTRACT

An elongated hollow tubular member for drinking the beverage, an agitator for mixing the beverage, and a linear to rotary mechanism combining the elongated hollow tubular member and the agitator for converting linear motion of the elongated hollow tubular member to rotary motion of the agitator for mixing the beverage.

19 Claims, 5 Drawing Sheets

(56) References Cited

U.S. PATENT DOCUMENTS

| | | | | |
|---|---|---|---|---|
| 7,731,101 | B2 * | 6/2010 | Fabrizio | A47J 43/1093 239/33 |
| 8,313,644 | B2 | 11/2012 | Harris et al. | |
| D700,807 | S | 3/2014 | Kershaw et al. | |
| 8,936,387 | B2 * | 1/2015 | Venot | B01F 13/002 366/129 |
| D742,174 | S | 11/2015 | Roth et al. | |
| 9,173,514 | B2 * | 11/2015 | Takumah | B01F 7/00183 |
| D781,640 | S | 3/2017 | Roth et al. | |
| 10,213,053 | B2 * | 2/2019 | Dayton | B01F 13/005 |
| 2002/0048215 | A1 * | 4/2002 | McGill | A47J 43/0727 366/249 |
| 2005/0263006 | A1 * | 12/2005 | Saha | A47J 19/005 99/275 |
| 2007/0211562 | A1 * | 9/2007 | Pitsis | A47G 21/181 366/129 |
| 2008/0080299 | A1 * | 4/2008 | Takumah | B01F 13/002 366/129 |
| 2008/0128529 | A1 * | 6/2008 | Fernandez | A47G 21/181 239/33 |
| 2008/0259723 | A1 * | 10/2008 | Rhodes | B01F 7/00183 366/247 |
| 2011/0059216 | A1 | 3/2011 | Takumah | |
| 2011/0062168 | A1 * | 3/2011 | Chow | B65D 23/12 220/705 |
| 2013/0010568 | A1 * | 1/2013 | Bodum | A47J 43/105 366/130 |
| 2013/0292857 | A1 | 11/2013 | Connors | |
| 2015/0093477 | A1 | 4/2015 | McNamara | |
| 2015/0283037 | A1 | 10/2015 | Trejo | |
| 2015/0366406 | A1 | 12/2015 | Hilscher | |
| 2016/0129405 | A1 * | 5/2016 | Dey | B01F 11/0082 366/129 |
| 2016/0235252 | A1 | 8/2016 | Muir et al. | |
| 2017/0056850 | A1 | 3/2017 | Kershaw et al. | |

FOREIGN PATENT DOCUMENTS

| | | | |
|---|---|---|---|
| CN | 203234478 | U | 10/2013 |
| CN | 20366721 | U | 6/2014 |
| CN | 203724475 | U | 7/2014 |
| CN | 104688543 | A | 6/2015 |
| CN | 205163673 | U | 4/2016 |
| CN | 105817164 | A | 8/2016 |
| CN | 105832562 | A | 8/2016 |
| CN | 206151310 | U | 5/2017 |
| DE | 3221978 | A1 | 1/1983 |
| KR | 200174896 | Y1 | 3/2000 |
| KR | 100331390 | B1 | 4/2002 |
| KR | 20020053682 | A | 7/2002 |
| KR | 200472652 | Y1 | 5/2014 |
| KR | 20120132481 | A | 5/2014 |
| WO | WO2016077929 | A1 | 5/2016 |

* cited by examiner

DRINKING STRAW WITH AGITATOR

CROSS-REFERENCE TO RELATED APPLICATIONS

The present application claims the benefit of U.S. Provisional Patent Application No. 62/617,402 filed Jan. 15, 2018, which is incorporated herein by reference.

TECHNICAL FIELD

The present disclosure relates to accessory straws. More specifically, this disclosure relates to accessory straws with an agitator for use with containers of consumable beverages.

BACKGROUND INFORMATION

Beverages of many types are consumed by persons at an increasing rate. Alcoholic and non-alcoholic beverages are consumed at breakfast, lunch, dinner and at various times throughout the day. Beverages are consumed for many reasons, such as nourishment, thirst, societal, replacement of minerals and/or vitamins, etc.

Many beverages primarily consist of a single liquid phase, such as wine, beer, milk, etc. However, other beverages may contain more than one liquid phase, such as mixed drinks, coffee with cream and sugar, etc. In either case, the beverage should be mixed (i.e., stirred) at least occasionally for purposes of taste and enjoyment. This objective to mix is most evident after a multi-phase beverage is placed or poured into a container, such as a glass or a cup, to prevent or at least minimize the separation of the beverage into component phases (or layers).

While accessories for beverage containers are currently available, such as straws, stirrers and swizzle sticks, the beverage-consuming public continues to look for new accessories which will enhance their enjoyment and consumption of beverages, especially multi-phase beverages.

Therefore, there is a need for new and effective accessory straws with an agitator that allows for thorough mixing of the beverage for enhanced enjoyment.

SUMMARY

In accordance with one aspect of the present invention, an apparatus for drinking and mixing a beverage in a container is provided. The drinking apparatus comprises of an elongated hollow tubular member for drinking the beverage, an agitator for mixing the beverage, and a linear to rotary mechanism combining the elongated hollow tubular member and the agitator for converting linear motion of the elongated hollow tubular member to rotary motion of the agitator for mixing the beverage.

In one implementation, the linear to rotary mechanism comprises of a raised spiral around the elongated hollow tubular member, a driver combined to the raised spiral and combined to the agitator. An orifice and a pair of indentations can be positioned on opposite sides of the orifice. The driver fits around the elongated hollow tubular member with the pair of indentations fitted on the raised spiral around the elongated hollow tubular member in a threaded bolt and screw relationship.

The driver can further comprise of downwardly projecting teeth, and the agitator comprises of an upper crown with an orifice that fits around the elongated hollow tubular member with the pair of indentations on opposite sides of the orifice to position the upper crown on the elongated hollow tubular member with the indentations fitted on the raised spiral around the elongated hollow tubular member. The upwardly projecting teeth mate with the downwardly projecting teeth of the driver to create a positive connection between the driver and the agitator.

The agitator can comprise of a lower crown positioned apart from the upper crown by at least two members. Each of the at least two members can comprise of a fin for increasing a surface area of the agitator.

The drinking apparatus can be combined with the container by a clip comprising a body. An orifice can be provided through the body for fitting the clip around the elongated hollow tubular member of the straw. A pair of downwardly extending arms can be positioned on opposite sides of the body for attaching the apparatus to the container. For other types of containers, a flexible sleeve that adapted to fit on the body of the clip between an upper collar on top of the body and a lower collar on the body of the body can be provided. The sleeve increases the diameter of the clip for attaching the apparatus to the container by friction fit in the mouth of the container.

BRIEF DESCRIPTION OF THE DRAWINGS

These and other features and advantages of the present invention will be better understood by reading the following detailed description, taken together with the drawings wherein.

DETAILED DESCRIPTION OF THE PREFERRED EMBODIMENTS

Figure 2:
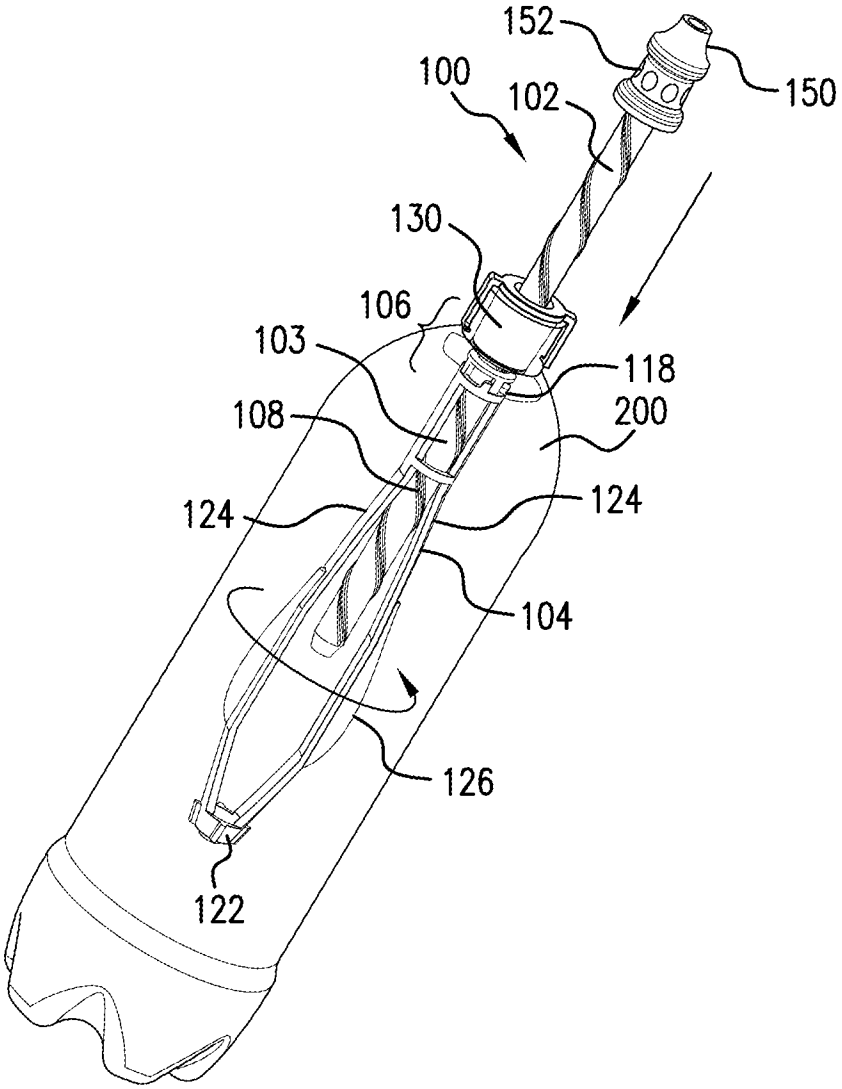
FIG. 2 is a perspective view of the drinking straw with agitator of FIG. 1 with the straw in the extended position.
Figure 1:
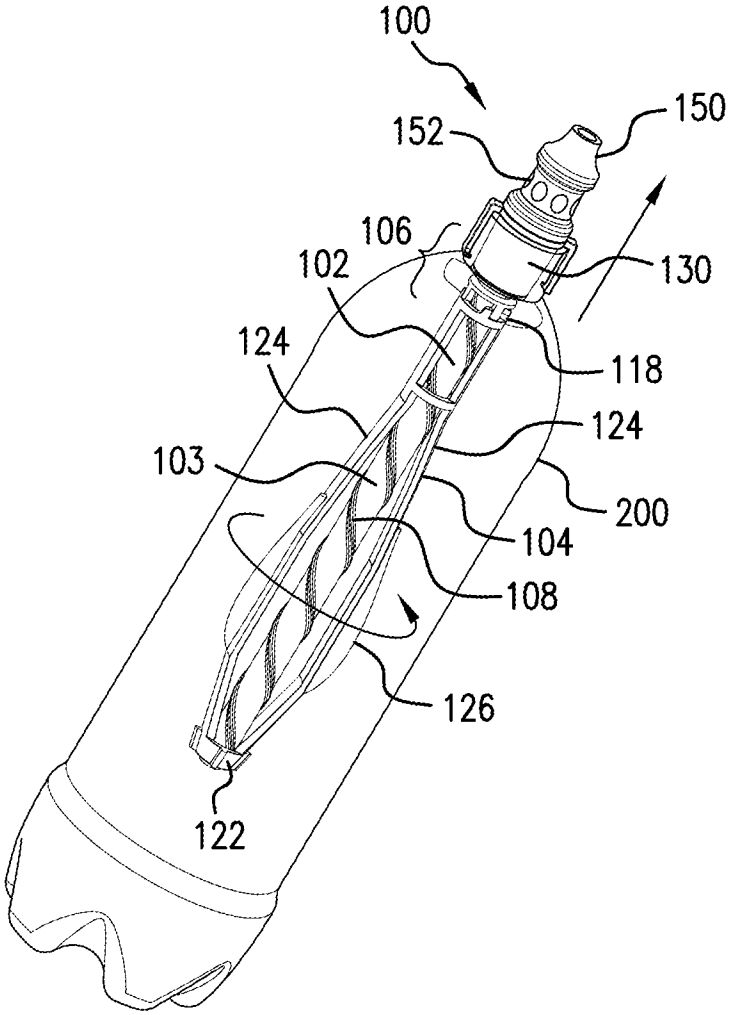
FIG. 1 is a perspective view of a drinking straw with agitator according to this disclosure combined to a container.

Referring to FIGS. 1-2, a drinking apparatus 100 according to this disclosure is shown in relation to a container 200. Drinking apparatus 100 is a portable and removable straw 102 combined with an agitator 104 that fits inside container 200. The user, by way of up and down linear motion of straw 102, causes rotary motion of the agitator 104 for mixing the beverage in container 200. Drinking apparatus is shown more specifically in FIGS. 3-5.

Figure 3:
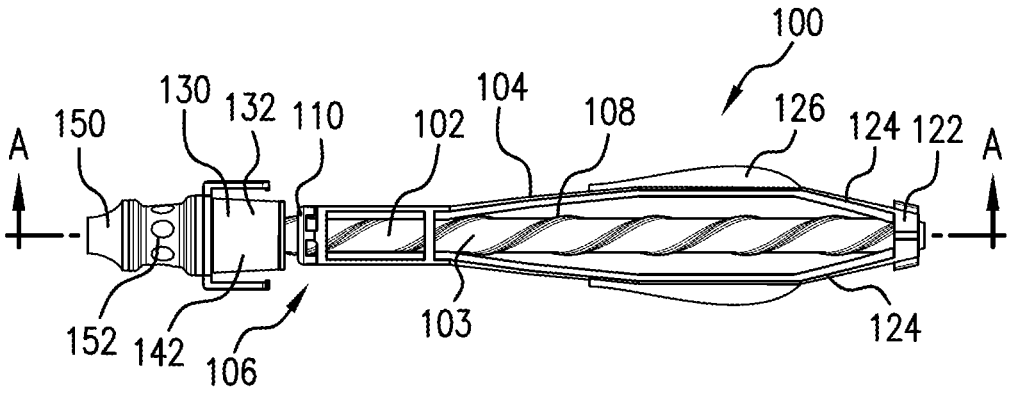
FIG. 3 is a perspective view of the drinking straw with agitator of FIG. 1.
Figure 4:
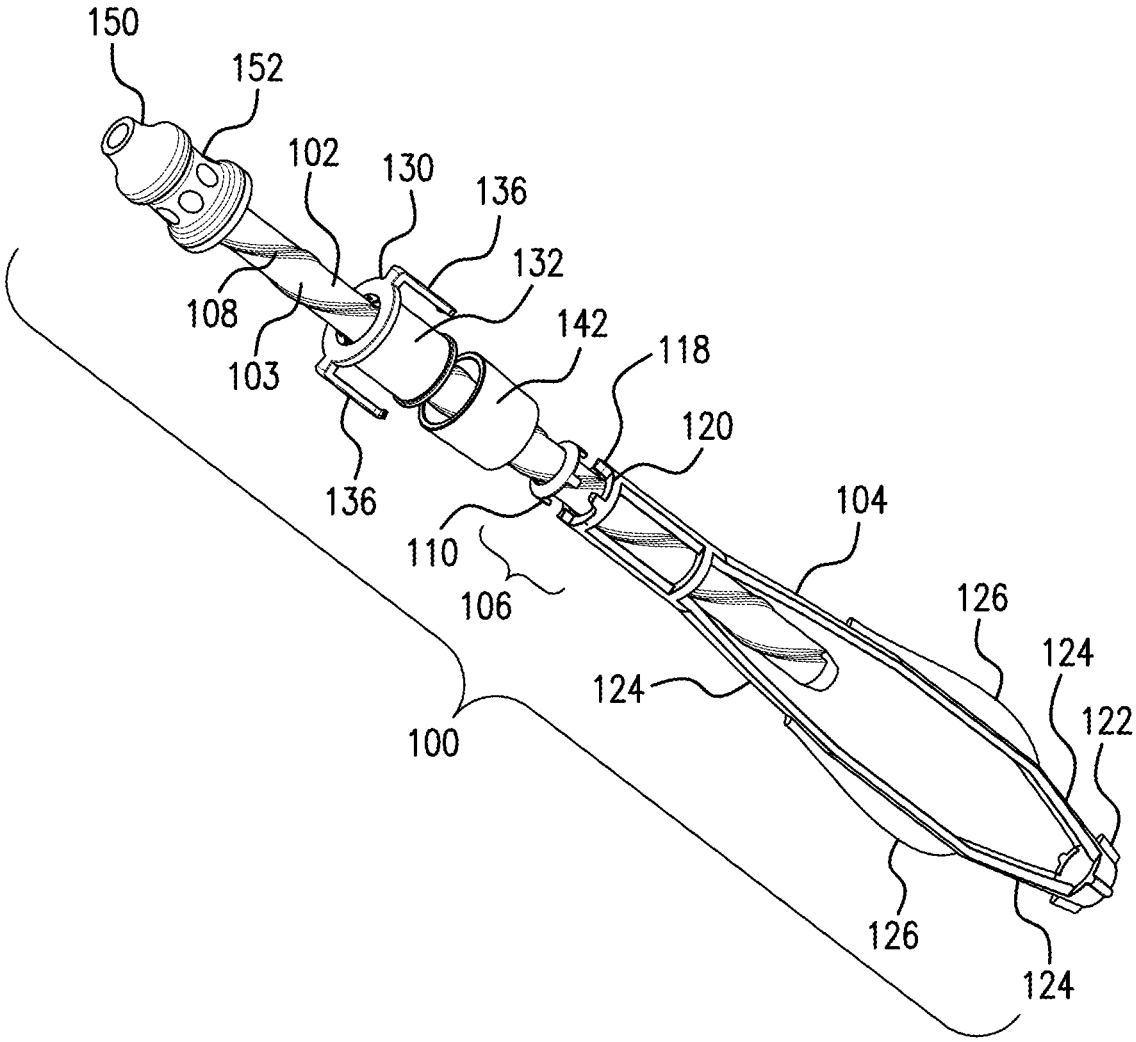
FIG. 4 is a partially exploded view of the drinking straw with agitator of FIG. 3.
Figure 5:
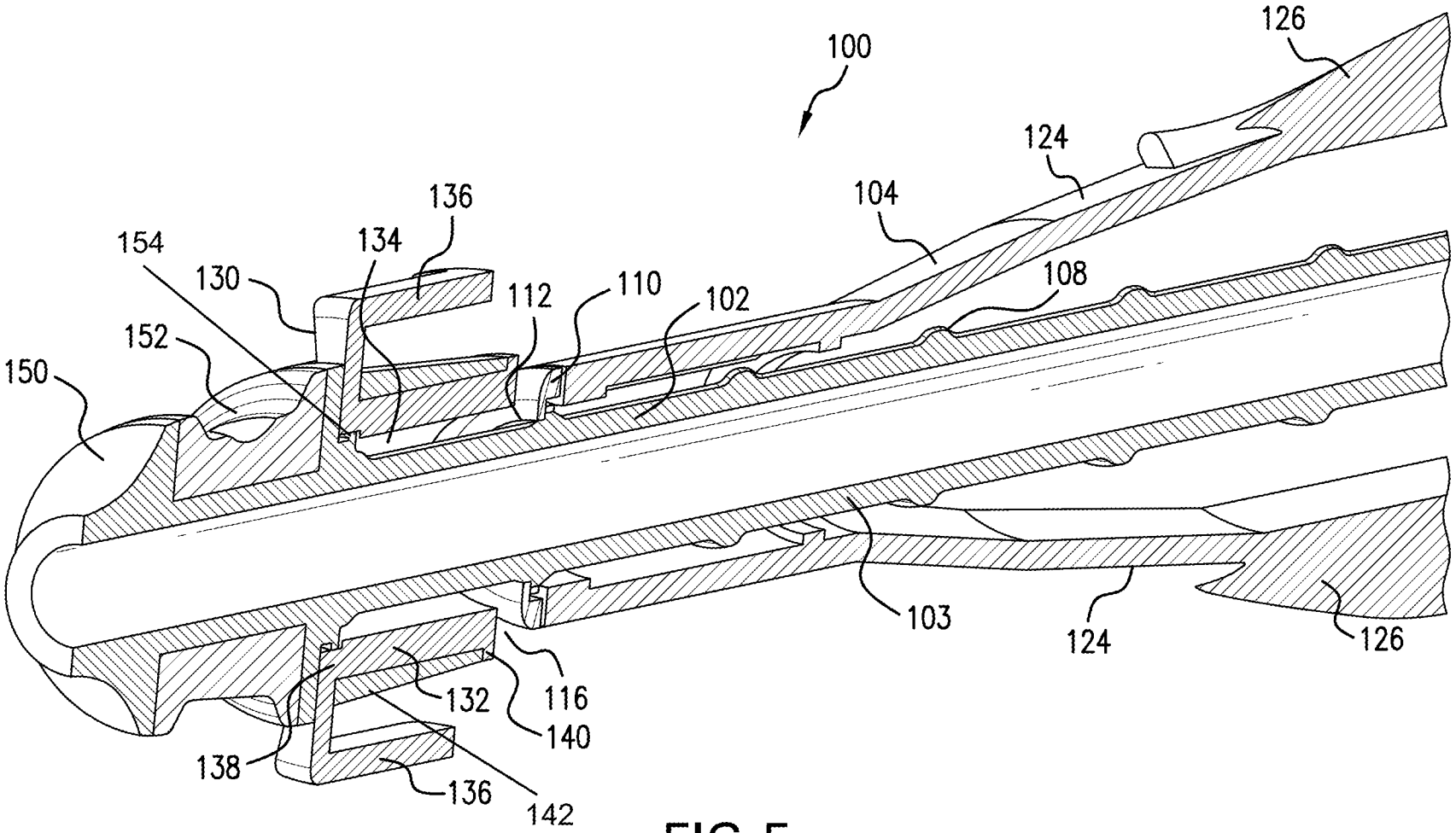
FIG. 5 is a cross-sectional view taken along the line A-A of FIG. 3.

Turning to FIGS. 3-5, drinking apparatus 100 according to this disclosure is show in detail. Drinking apparatus 100 comprises generally of straw 102 comprising an elongated hollow tubular member 103 for drinking the beverage, agitator 104 for mixing the beverage, and a linear to rotary mechanism 106 combining the elongated hollow tubular member 103 of straw 102 and agitator 104 for converting linear motion of the elongated hollow tubular member of straw 102 to rotary motion of agitator 104 for mixing the beverage.

More specifically, linear to rotary mechanism 106 comprises of a raised spiral 108 around the elongated hollow tubular member 103 of straw 102, a driver 110 combined to raised spiral 108 and combined to agitator 104. Raised spiral 108 can be integrally formed on straw 102 as a raised thread that spirally wraps around the elongated hollow tubular member 103 of straw 102. Driver 110 has a corresponding mating thread that mates with raised spiral 108 to convert linear motion of straw 102 to rotary motion of agitator 104.

Figure 7:
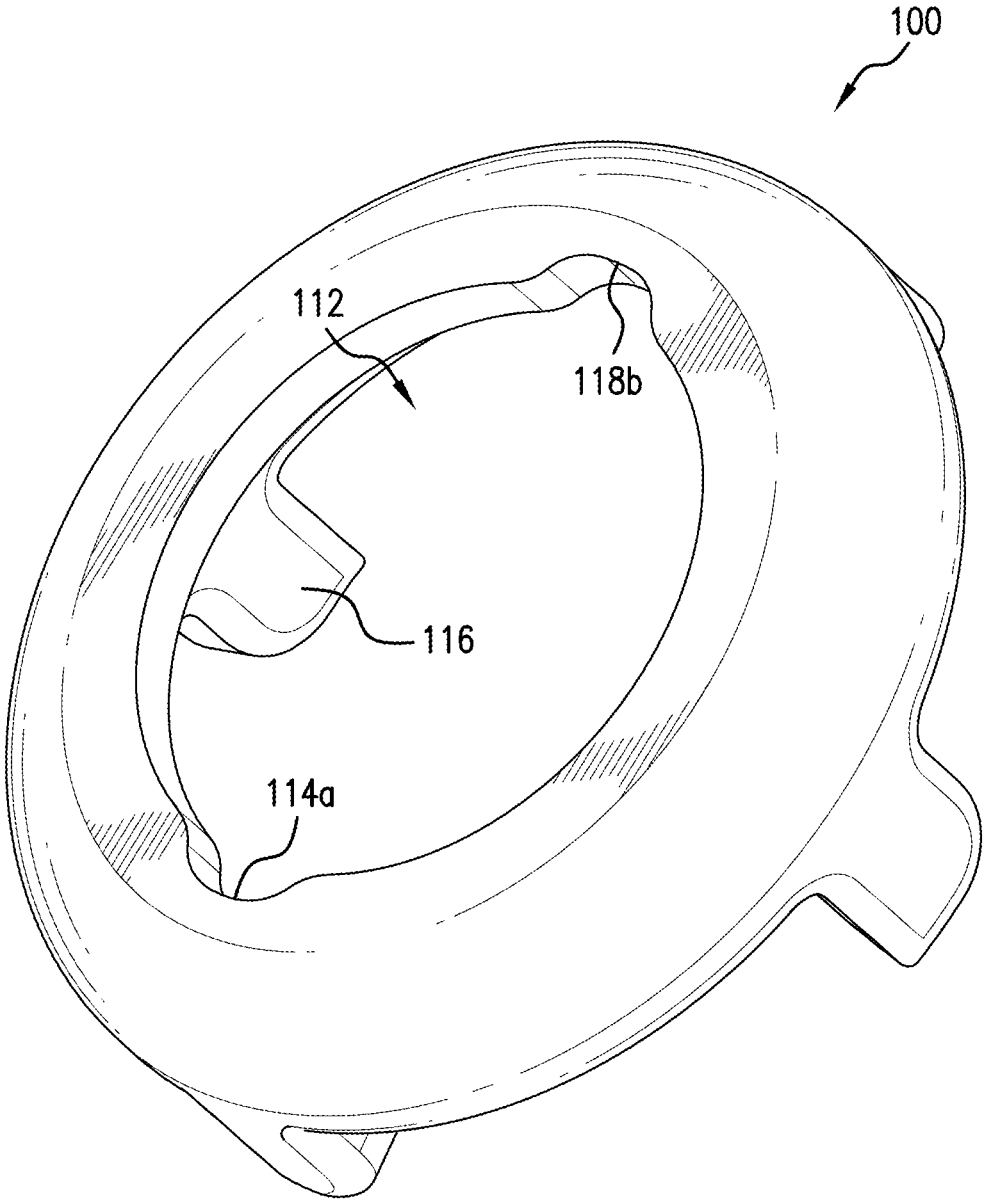
FIG. 7 is a perspective view of the driver of FIG. 3.

FIG. 7 shows a close up view of driver 110. Driver 110 comprises of an orifice 112 and a pair of indentations 114*a*, 114*b* on opposite sides of orifice 112. Returning to FIGS. 3-5, shown is driver 110 fitted on elongated tubular member of straw 102 with pair of indentations 114*a*, 114*b* fitted on raised spiral 108 of straw 102. Driver 110 also comprises of downwardly projecting teeth 116 to mate with corresponding upwardly projecting teeth 118 of agitator 104.

Figure 6:
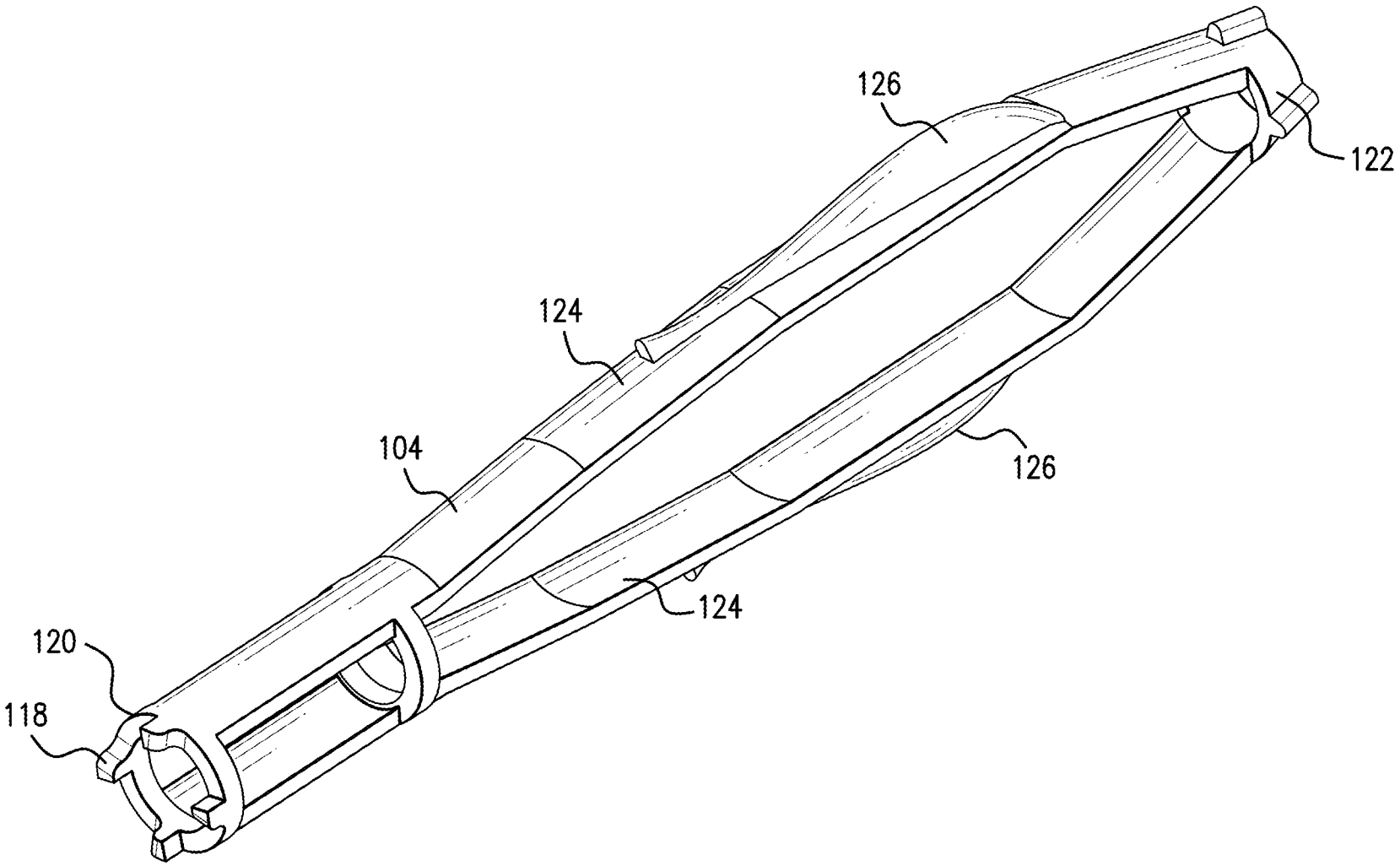
FIG. 6 is a perspective view of the agitator of FIG. 3.

Agitator 104, which is shown in close-up in FIG. 6, comprises of an upper crown 120 with an orifice with a smooth bore that fits around the elongated hollow tubular member 103 of straw 102 to position upper crown 120 on the elongated hollow tubular member 103 of straw 102. Upwardly projecting teeth on crown 120 of agitator 104 mates with the downwardly projecting teeth 116 of driver 110 to create a positive connection between driver 110 and agitator 104.

Agitator 104 further comprises of a lower crown 122 positioned apart from upper crown 120 by at least two members 124. Each of at least two members 124 further comprises of a fin 126 for increasing a surface area of agitator 104. This increased surface area allows for thorough mixing of the beverage of any liquid and particulate elements. Lower crown 122 of agitator 104 can comprise an orifice for positioning agitator 104 on a raised inner portion of container 200. For containers with such a raised inner portion, such as plastic soda bottles, this would allow agitator 104 to be centrally maintained for a more sturdy balanced rotation.

Drinking apparatus 100 can further comprise of a clip 130 comprising a body 132 comprising an orifice 134 therethrough for fitting body 132 of clip 130 around the elongated hollow tubular member 103 of straw 102. Body 132 of clip 130 can further comprise of at least two downwardly extending arms 136 positioned on opposite sides of body 132 for attaching drinking apparatus 100 to container 200. Clip 130 can further comprise of an upper collar 138 on top of body 132 from which at least two downwardly extending arms 136 extend.

In some situations, for example, with glass bottles, body 132 of clip 130 may require a wider diameter. In such situations, clip 130 can comprise a lower collar 140 on the bottom of body 132 to retain a flexible sleeve 142 that adapted to fit on body 132 of clip 130 between upper collar 138 and lower collar 140 of body 132 of clip 130. Flexible sleeve 142 increases the diameter of body 132 of clip 130 for frictionally fitting clip 130 in the mouth of container 200.

Straw 102 of drinking apparatus 100 can also comprise ergonomic and aesthetic features. At the mouth end of elongated hollow tubular member 103 of straw 102, a tapered mouthpiece 150 for receiving the mouth of a user can be provided. Mouthpiece 150 can be made of a flexible material that includes a sealing valve that is opened by the external pressure of the user's lips. Straw 102 can also comprise an ergonomic gripping portion 152 for gripping by the user while the user imparts the up and down linear motion of straw 102 to mix the beverage.

Turning to FIG. 5, straw 102 can further comprise of a latch 154 to fix straw 102 in the downward position to clip 130. Beneath gripping portion 154 is latch 154 that fits to a corresponding protuberance on upper collar 138 on top of body 132 of clip 130. To lock straw 102 to clip 130, move straw to the down position and give it a slight ninety degree turn to position latch 154 under the protuberance on upper collar 138 of clip 130. To unlock, merely reverse the turning of straw 102. Those skilled in the art will recognize that other fastening mechanisms can be used to hold down straw 102, such as a friction fit between a portion of elongated hollow tubular member 103 of straw 102 and orifice 134 of clip 130 or a physical latch between straw 102 and clip 130.

Returning back to FIGS. 1-2, the operation of drinking apparatus 100 will be described with reference to the preceding detailed description. The user inserts agitator 104 into container 200. Straw 102 is inserted into container 200 and combined with agitator 104 by linear to rotary mechanism 106. More specifically, driver 110 is fitted on raised spiral 108 around the elongated hollow tubular member 103 of straw 102. The elongated tubular member of straw 102 is inserted through upper crown 120 of agitator 104 so that downwardly projecting teeth 116 of driver 110 mates with corresponding upwardly projecting teeth 118 of agitator 104. Clip 130 is inserted into and temporarily fixed into the opening of container 200 to attach drinking apparatus 100 to container 200.

To stir the beverage, the user merely clasps straw 102 and moves it up and down. The driver is moved up against lower collar 142 of body 132 of clip 130. In a screw and nut type fashion, linear movement of straw 102 via raised spiral 108 on elongated hollow tubular member 103 of straw 102 causes rotation of driver 110. The positive connection between driver 110 and agitator 104 causes a corresponding rotation of agitator 104. As straw 102 is moved linearly upward, agitator 104 rotates in one direction. As straw 102 is moved linearly downward, agitator 104 rotates in the opposite direction. Drinking apparatus 100 provides the user with a convenient and portable mechanism for drinking a beverage and keeping the contents thoroughly mixed.

Those skilled in the art would understand that the foregoing drinking apparatus 100 can be modified to fit any size or shape of container 200 without departing from the scope of this disclosure. The components making of drinking apparatus 100 can be made of any one or more of plastic, metal, rubber, silicon, hardened paper, paper mache, etc. A combination of silicon or rubber grommets can be used to increase sealing. Agitator 104 can be formed with members 124 and fins 126 of various shapes, styles, and configurations to adapt to containers 200 of various sizes and various blending/mixing applications. Driver 110 can come in various height and diameter dimensions to allow for customization for the particular application. Clip 130 can also be made in various manners to fit containers of different sizes.

In alternative implementations, linear to rotary mechanism 106 to translate linear motion of straw 102 to rotary motion of agitator 104 are contemplated. For example, a slider-crank mechanism, an alternative threaded relationship between straw 102 and agitator 104, a slider crank, etc.

While the principles of the invention have been described herein, it is to be understood by those skilled in the art that this description is made only by way of example and not as a limitation as to the scope of the invention. Other embodiments are contemplated within the scope of the present invention in addition to the exemplary embodiments shown and described herein. Modifications and substitutions by one of ordinary skill in the art are considered to be within the scope of the present invention, which is not to be limited except by the following claims.

I claim:

1. An apparatus for drinking and mixing a beverage in a container, the apparatus comprising:

an elongated hollow tubular member for drinking the beverage;

an agitator for mixing the beverage; and a linear to rotary mechanism combining the elongated hollow tubular member and the agitator for converting linear motion of the elongated hollow tubular member to rotary motion of the agitator for mixing the beverage.

2. The apparatus of claim 1, wherein the linear to rotary mechanism comprises of a raised spiral around the elongated hollow tubular member, a driver combined to the raised spiral and combined to the agitator.

3. The apparatus of claim 2, wherein the driver further comprises of an orifice and a pair of indentations on opposite sides of the orifice, wherein the driver fits around the elongated hollow tubular member with the pair of indentations fitted on the raised spiral around the elongated hollow tubular member.

4. The apparatus of claim 3, wherein the driver further comprises of downwardly projecting teeth, and the agitator comprises of an upper crown with an orifice that fits around the elongated hollow tubular member with the pair of indentations on opposite sides of the orifice to position the upper crown on the elongated hollow tubular member with the indentations fitted on the raised spiral around the elongated hollow tubular member, and upwardly projecting teeth that mate with the downwardly projecting teeth of the driver to create a positive connection between the driver and the agitator.

5. The apparatus of claim 4, wherein the agitator further comprises of a lower crown positioned apart from the upper crown by at least two members, wherein each of the at least two members further comprises of a fin for increasing a surface area of the agitator.

6. The apparatus of claim 5, a clip comprising a body comprising an orifice therethrough for fitting the clip around the elongated hollow tubular member, a pair of downwardly extending arms positioned on opposite sides of the body for attaching the apparatus to the container.

7. The apparatus of claim 6, wherein the clip further comprises an inward protrusion on each of the downwardly extending arms for catching a thread on the container for attaching the apparatus to the container.

8. The apparatus of claim 7, wherein the clip further comprises an upper collar on top of the body from which the downwardly extending arms extend and a lower collar on a bottom of the body.

9. The apparatus of claim 8, and further comprising a flexible sleeve adapted to fit on the body of the clip between the upper collar on top of the body and the lower collar on the body of the body for increasing a diameter of the clip for attaching the apparatus to the container.

10. The apparatus of claim 9, wherein the lower crown of the agitator comprises an orifice for positioning the agitator on a raised inner portion of the container.

11. The apparatus of claim 10, wherein the elongated hollow tubular member has a tapered mouth piece for receiving the mouth of a user.

12. An apparatus for drinking and mixing a beverage in a container, the apparatus comprising:

a straw comprising an elongated hollow tubular member for drinking the beverage;

an agitator for mixing the beverage; and a linear to rotary mechanism combining the straw and the agitator for converting linear motion of the straw to rotary motion of the agitator for mixing the beverage.

13. The apparatus of claim 12, wherein the linear to rotary mechanism comprises of a raised spiral around the elongated hollow tubular member of the straw, a driver combined to the raised spiral and combined to the agitator.

14. The apparatus of claim 13, wherein the driver further comprises of an orifice and a pair of indentations on opposite sides of the orifice, wherein the driver fits around the elongated hollow tubular member of the straw with the pair of indentations fitted on the raised spiral around the elongated hollow tubular member of the straw.

15. The apparatus of claim 14, wherein the driver further comprises of downwardly projecting teeth, and the agitator comprises of an upper crown with an orifice that fits around the elongated hollow tubular member of the straw with the pair of indentations on opposite sides of the orifice to position the upper crown on the elongated hollow tubular member of the straw with the indentations fitted on the raised spiral around the elongated hollow tubular member of the straw, and upwardly projecting teeth that mate with the downwardly projecting teeth of the driver to create a positive connection between the driver and the agitator.

16. The apparatus of claim 12, wherein the agitator further comprises of a lower crown positioned apart from an upper crown by at least two members, wherein each of the at least two members further comprises of a fin for increasing a surface area of the agitator; wherein the lower crown of the agitator comprises an orifice for positioning the agitator on a raised inner portion of the container.

17. The apparatus of claim 12, and further comprising a clip comprising: a body comprising an orifice therethrough for fitting the clip around the elongated hollow tubular member of the straw, a pair of downwardly extending arms positioned on opposite sides of the body for attaching the apparatus to the container; an inward protrusion on each of the downwardly extending arms for catching a thread on the container for attaching the apparatus to the container; and an upper collar on top of the body from which the downwardly extending arms extend and a lower collar on a bottom of the body.

18. The apparatus of claim 17, and further comprising a flexible sleeve adapted to fit on the body of the clip between the upper collar on top of the body and the lower collar on the body of the body for increasing a diameter of the clip for attaching the apparatus to the container.

19. The apparatus of claim 12, wherein the straw comprises a tapered mouth piece for receiving the mouth of a user and a gripping portion for gripping by the user to move the straw upward and downward linear motion to rotate the agitator for mixing the beverage.

* * * * *